United States Patent [19]

Hannes et al.

[11] Patent Number: 4,478,129

[45] Date of Patent: Oct. 23, 1984

[54] APPARATUS FOR THE EXACT POSITION FEEDBACK OF A DOUBLE-ACTING POWER PISTON IN A HYDRAULIC POWER CYLINDER

[75] Inventors: Heinz D. Hannes, Düren-Echtz; Josef Lothmann, Langerwehe; Ludwig Walther, Düren-Niederau, all of Fed. Rep. of Germany

[73] Assignee: Zimmermann & Jansen GmbH, Düren, Fed. Rep. of Germany

[21] Appl. No.: 249,925

[22] Filed: Apr. 1, 1981

[30] Foreign Application Priority Data

Apr. 15, 1980 [DE] Fed. Rep. of Germany ..... 3014432

[51] Int. Cl.[3] ..... F01B 25/26

[52] U.S. Cl. ..... 91/1; 91/189 R; 91/422

[58] Field of Search ..... 91/189 R, 401, 1, 422; 92/5 R; 60/426, 534, 328, 431, 432; 137/557

[56] References Cited

U.S. PATENT DOCUMENTS

| | | | |
|---|---|---|---|
| 2,526,646 | 10/1950 | Ericson | 60/431 |
| 3,752,039 | 8/1973 | Hewins | 60/426 |
| 3,961,559 | 6/1976 | Teramachi | 91/422 |
| 3,991,832 | 11/1976 | Cooper | 91/401 |
| 4,050,359 | 9/1977 | Mayer | 91/422 |
| 4,091,715 | 5/1978 | Onderka | 91/1 |
| 4,151,785 | 5/1979 | Koschek | 91/189 R |
| 4,215,746 | 8/1980 | Hallden et al. | 137/557 |
| 4,268,228 | 5/1981 | McKee | 91/189 R |

FOREIGN PATENT DOCUMENTS 1125999 11/1956 France ..... 91/401

*Primary Examiner*—Robert E. Garrett
*Assistant Examiner*—Richard L. Klein
*Attorney, Agent, or Firm*—Holman & Stern

[57] ABSTRACT

The invention relates to an apparatus for the exact position feedback of a double-acting power piston in a hydraulic power cylinder subjected to extreme environmental conditions, especially high temperatures, comprising a likewise double-acting detecting (measuring) or follower cylinder having a volume equivalent to that of said power cylinder and including a detecting piston the position of which can be sensed by electric means, wherein a pair of working spaces of power and detecting cylinders are in fluid communication with each other via a connecting pipe, while the respective other working spaces are adapted to be connected to a (pressurized) fluid pump or a reservoir through a control valve. This apparatus comprises pressure limiting switches which are each positioned in said connecting pipe as well as in the fluid line extending between said power cylinder and said control valve; and both said power piston and said detecting piston each include a valve-controlled acknowledgement passage by means of which fluid communication can be established between said two working spaces or of said power and detecting cylinders.

2 Claims, 11 Drawing Figures

APPARATUS FOR THE EXACT POSITION FEEDBACK OF A DOUBLE-ACTING POWER PISTON IN A HYDRAULIC POWER CYLINDER

BACKGROUND OF THE INVENTION

1. Field of the Invention

The present invention relates to an apparatus for the exact position feedback of a double-acting power piston in a hydraulic power cylinder subjected to extreme environmental conditions, especially high temperatures, comprising a double-acting detecting (measuring) or follower cylinder having a volume equivalent to that of said power cylinder and including a detecting piston the position of which can be sensed by electric means, wherein a pair of working spaces of power and detecting cylinders are in fluid communication with each other via a connecting pipe, while the respective other working spaces are adapted to be connected to a (pressurized) fluid pump or a reservoir through a control valve.

2. Description of the Prior Art

In an apparatus of this type, it has been proposed to connect to the connecting pipe between the two working spaces of the power cylinder and the detecting or measuring cylinder, which are in fluid communication with each other, a pipe or line directly connected to the pump and having disposed therein a (pressure limiting) relief valve. Furthermore, according to this proposal, said connecting pipe was joined to another pipe or line leading directly to the reservoir and likewise including a relief valve for the return of excessive pressurized medium from the two interconnected working spaces. The first mentioned relief valve, controlled directly by the pump pressure, is intended to open each time when (pressurized) fluid (leakage) losses from the pair of interconnected working spaces of the power and detecting cylinders are to be compensated for. Tests have revealed that adjustment of the (pressure limiting) relief valves is extremely difficult, and that these valves greatly vary their settings in the course of operation owing to varying volume flows acting upon them. In addition, it has been found that when an excess amount of liquid is present in the fluid interconnected working spaces of power and detecting cylinders, a pressure is built up in the connecting pipe due to the direct pressurizing by the pump of the piston which has not yet reached its terminal position, which pressure is equal to the (value of) setting of the relief valve in the line extending to the reservoir, before the excess volume is relieved through said valve. This means that in such case, for example, the power cylinder is operated only by the differential pressure between the pump pressure and the set pressure of the respective relief valve.

Also, the proposed construction cannot positively ensure that, for example, the power piston will actually reach the respective terminal position. In the case of a blocking of e.g. a nozzle damper of a casting ladle, being coupled to the power piston rod, the power piston comes to stop in an intermediate position, thereby simulating a terminal position by a pressure rise. Such pressure rise would result in opening of the above-mentioned pump-controlled relief valve and, thus, movement of the sensing or detecting piston to the respective final position. The detecting piston would thereby indicate a terminal position, although the power piston has not yet reached its terminal position.

BRIEF SUMMARY OF THE INVENTION

Accordingly, it is the object of the present invention to provide an apparatus of the type as outlined above, which with absolute positiveness provides for exact position feedback and particularly also for synchronization of power piston and detecting piston preferably for controlled operation of a casting ladle slide gate valve.

According to the present invention, this object is achieved by providing a pressure limiting switch in said connecting pipe as well as in the fluid line extending between said power cylinder and said control valve; and by both said power piston and said detecting piston include a valve-controlled acknowledgement passage by means of which fluid communication can be established between said two working spaces of said power and detecting cylinders.

The solution according to the invention in extremely ready manner eliminates the drawbacks and disadvantages of the abovementioned prior construction. The solution according to the invention provides for positive linkage (coupling) of the absolute terminal positions of power and detecting pistons. The solution according to the invention does not require any additional electrical or electronic signal transmitters and connection elements which in any event can be used with reservations only under extreme environmental conditions.

Preferable, the acknowledgement passages are each formed by a passage or channel extending approximately in parallel with the cylinder axis and having positioned therein a pair of oppositely acting check valves the valve elements of which are each adapted to be lifted off their respective valve seats by plungers protruding beyond the respective piston front face upon contact with the respectively opposing cylinder front face. As check valves, the cartridge-type check valves type 250-CFK-005, manufactured by LEE Company, Conn. 06 498, USA, have proved to be particularly useful. As indicated, each check valve includes a mechanical plunger which, when contacted by the respective cylinder end face or the respective cylinder cover, opens the valve in opposition to its actual flow direction. The opposite valve which is not operated in this cycle, at the same time blocks the passage such that starting or abutment of the piston in the opposite direction becomes possible.

The mechanically controlled acknowledgement passages having the above-described construction additionally perform an oil cooling function, namely when both the detecting piston and the power piston are in their terminal positions and the pump is connected into the system. This is of high advantage particularly when the power cylinder is located in an environment of high temperature, and the power piston assumes its terminal positions quite frequently and for relatively long periods of time. In this case, as mentioned above, an oil circuit may be maintained relatively easily, and the oil may be cooled.

Thus, the invention is also characterized in that the power piston and the detecting piston in their abutting or terminal position have their valve-controlled acknowledgement passages steadily open to a predetermined extent at which a cooling oil flow is maintained through the circuit.

Preferable, the hot oil may be passed through a heat exchanger which is connected, for example, to a heating circuit for working spaces or the like.

When a given overpressure in the connecting pipe between the fluid interconnected working spaces or in the line between the power cylinder and the control valve is exceeded, the pressure limiting switches may interrupt the fluid flow or operate to cut off the pump. This prevents hydraulic couplings or the like from becoming overheated and leaking prematurely.

Advantageously, the pressure limiting switches have each associated therewith a pressure measuring device, with the pressure measuring devices being operatively connected to a signal converter which converts the pressure values to corresponding electric signals which may be processed, for example, in a function computer for controlling or maintaining a set-value (nominal) position of the power piston.

Preferably, the function computer is designed so as to perform a comparison between the electrically detected detecting piston positions and the measured pressure values converted to electric signals by the signal converter, in order to determine an exact power piston position and control a piston nominal position. In this way, a kind of "back-up system" is provided. When the electrical detection of the detecting piston position fails, the function of the apparatus according to the invention is substantially ensured by the evaluation of the measured pressure values.

BRIEF DESCRIPTION OF THE DRAWINGS

A preferred embodiment of the invention and its mode of function are explained below with reference to the accompanying drawings, wherein.

DETAILED DESCRIPTION

Figure 1:
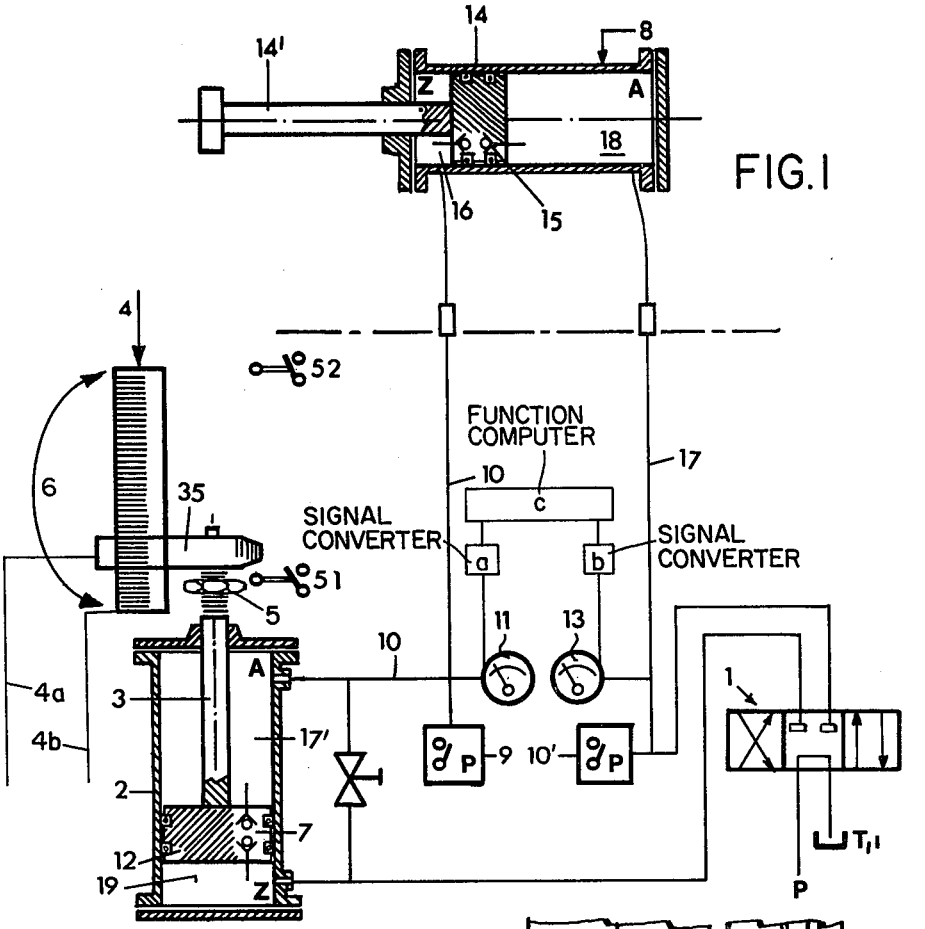
FIG. 1 is a hydraulic circuit diagram of the apparatus according to the invention.

Reference numeral 8 designates a power cylinder which is subjected to extreme environmental conditions, especially high temperatures. The piston rod 14' of the power piston 14 associated with the power cylinder 8 is connected, for example, to a casting ladle damper for controlling the movement thereof (not shown).

Located remote from the place of extreme environmental conditions is a measuring or detecting cylinder 2 having a volume equivalent to that of the power cylinder 8; in this structure, it is expedient to reduce the diameters of piston and piston rod with the same ratio relative to the power cylinder to thereby correspondingly increase the length of stroke and to obtain improved resolution of the stroke (length) of the detecting piston 12 associated with the detecting cylinder 2.

As the detecting cylinder 2 is not directly subjected to the severe steel production conditions or the like, this cylinder may be constructed at lesser cost than the power cylinder 8, particularly as far as the piston sealing means are concerned. As clearly shown in FIG. 1, the working spaces or chambers 16, 17' of the two cylinders 8,2, through which each pass the piston rods, are in direct fluid communication with each other by a connecting pipe 10. When the power piston 14 moves to the left in FIG. 1, the detecting piston 12 moves downwards, and vice versa. By the fluid communication 10, the return liquid in the power cylinder 8 has a direct influence on the position of the detecting piston 12 in the detecting cylinder 2. In this way, an exact position feedback (or remote indication) of the power piston 14 in the power cylinder 8 is provided. The free end of the piston rod 3 of the detecting piston 12, i.e. the end protruding out from the detecting cylinder 2, has attached thereto a mask 35 which extends into the block of an opto coupler 4. The mask 35 is hereby arranged so as to be freely adjustable in the direction of the detecting piston rod, and such adjustment may be effected simply by an adjustment nut 5. Associated with a fine thread, the adjustment nut 5 facilitates exact synchronization of the stroke lengths of the two pistons 12, 14 at any time. The opto coupler 4 is connected to a not illustrated electronic position indicator and/or a function computer. Such opto coupler 4 is a bar having a photosensitive scale 6 wherein each scale line is represented by an individual photosensitive element which produce a specific electrical signal through line **4*b* when a lamp arranged in the housing of mask 35 is illuminated by power through wires 4*a***.

The working spaces 18, 19 of the power and detecting cylinders, respectively, which are not in direct fluid communication with each other, are adapted to be connected to the pump P or to a reservoir T, respectively, through a 4/3-way valve 1. The pressurized medium (fluid) line between the control valve 1 and the power cylinder 8 or the working space 18, respectively, is indicated at 17. In the connecting pipe 10 and in the pressurized fluid line 17 extending between the power cylinder 8 and the control valve 1, one pressure limiting switch 9, 10' respectively, is arranged, which switches interrupt the fluid communications 10, 17, or cut off the pump P upon the occurence of a predetermined overpressure. Both pressure limiting switches each have further associated therewith a pressure measuring or indicating device or pressure gauge 11, 13. These pressure gauges represent auxiliary control means for the operator. In particular, a more-than-average pressure rise can thereby be recognized soon, which pressure rise would indicate that the power piston 14 is blocked in its movement or tends to be seized (for instance, when a casting ladle damper coupled to the power piston rod sticks in its respective position). When one of the pressure limiting switches 9 or 10' operates, this means that the power piston failed to reach its terminal position, irrespective of the fact whether or not the detecting piston 12 has actually reached its terminal position. In any case, the pressure limiting switches ensure that the pressure does not rise even further such that leakage of the hydraulic couplings, the piston seals, etc., could result. The pressure measuring device 11, 13 can each be optionally operatively connected to a signal converter a, b, respectively, which convert the pressure values to corresponding electrical signals which are fed to a function computer c for processing and controlling or maintaining a nominal (pre-set) position of the power piston.

Figure 2:
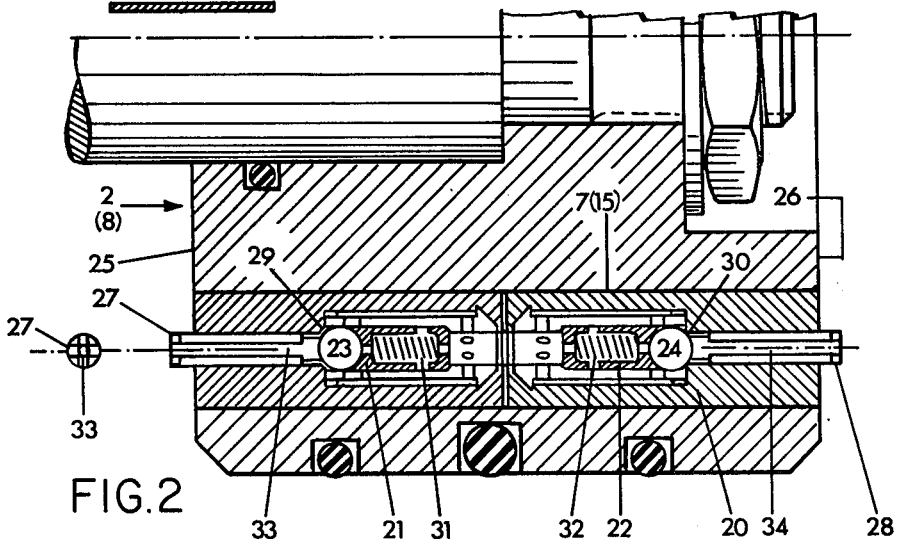
FIG. 2 is an enlarged cross sectional view of a portion of the power or detecting piston, respectively, including the valve-controlled acknowledgement passage.

Both the power piston 14 and the detecting piston 12 are provided with a valve-controlled acknowledgement passage 15 or 7, respectively, by means of which fluid communications may be established between the two working spaces 16, 18 or 17', 19, respectively, of the power and detecting cylinders. In this embodiment, the valve control is designed such that this fluid communication can be established only in the terminal positions of the pistons and with a proper flow direction of the pressurized fluid. With respect to the construction of the acknowledgement passage 7 or 15, reference is made to FIG. 2. According to FIG. 2, each acknowledgement passage 7 or 15 is formed by a passage or channel 20 extending through the pistons approximately in parallel with the cylinder axis and having disposed therein a pair of oppositely acting or counter-acting cartridge-type check valves 21, 22 the valve element balls 23, 24 of which are each adapted to be lifted off the respective valve seat 29, 30 by plungers 27, 28 protruded beyond the respective piston end face 25, 26 upon contact with the respectively opposing cylinder end face. The valve elements 23, 24 are each urged outwards against the associated valve seat 29, 30 by a spring 31, 32. Each plunger 27, 28 includes a passage 33, 34 to allow pressurized fluid to flow when the valves are opened. The springs 31, 32 are of such dimensions to allow the associated valve element ball 23, 24 to be urged away from the respective valve seat 29, 30 under the normal force of the pressurized fluid acting through the passage 33, 34 of the respective plunger 27, 28. Accordingly, for example, passage 33 is opened when the piston 2 or 8 is in its left hand terminal position according to FIG. 2 and the pressure acts from the right. In the left terminal position, the valve 21 is opened by the plunger 27 pressed into the passage 20, while the right hand valve 22 opens under the force of the pressurized fluid. In a similar manner, a fluid communication between the two working spaces separated from each other by the piston is established in the right hand terminal position according to FIG. 2.

Now, FIGS. 3*a* to 3*f* illustrate possible situations (combinations) of piston positions. Power and detecting cylinders as well as power and detecting pistons are identified by the same reference numerals as in FIG. 1. The space connected in fluid communication by the connection pipe 10 of FIG. 1 is indicated at R in FIGS. 3*a* to 3*f*, and the volume occupied by the working space 18 of the power cylinder 8 and of the fluid line 17 of FIG. 1, adapted to be connected to the pump P or the reservoir T, respectively, is designated with R'. Numerals Z and A mean "terminal position—closed" and "terminal position—open", respectively.

Figure 3A:
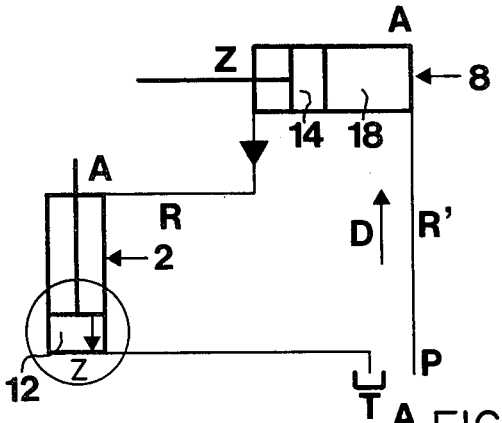
FIGS. 3*a* to 3*f* are schematic diagrams of possible switching states of the acknowledgement passages of power and detecting pistons.

Although the detecting piston 12 according to FIG. 3*a* has reached its terminal position Z, the power piston 14 is not yet in its corresponding position Z. Therefore, an excess of liquid exists within space or chamber R. Under these conditions, the acknowledgement passage 7 of the detecting piston 12 opens, and the excess liquid in space R is drained to the reservoir T through the detecting piston 12.

Figure 3B:
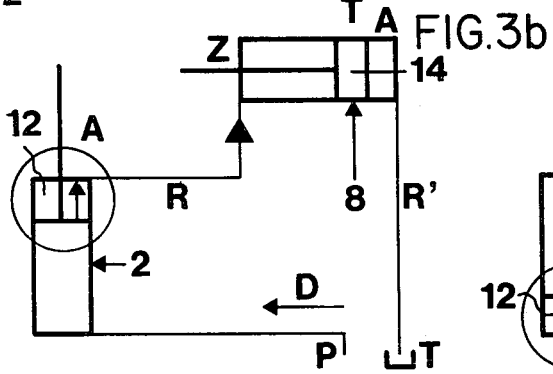

According to FIG. 3*b*, the detecting piston 12 is in its opposite terminal position A, whereas the power piston 14 has not yet reached the corresponding terminal position. This means that liquid has flown out from space R past the piston seals (leakage). In the terminal position A of the detecting piston 12, the acknowledgement passage 7 thereof is opened again by pressure action in the direction of arrow D, whereby the leakage volume from space R is compensated for and the power piston 14 is moved into its terminal position A.

Figure 3C:
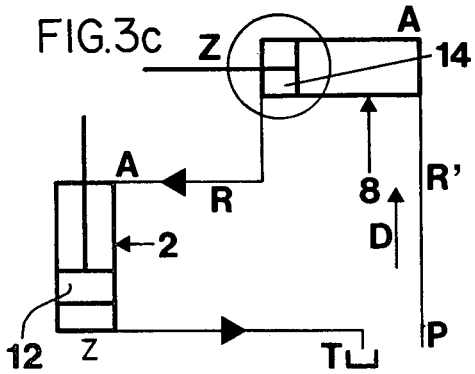

In FIG. 3*c*, the power piston 14 is in its terminal position Z, while the detecting piston 12 has not yet reached its terminal position. When the power piston 14 is acted upon by pressure in the direction of arrow D, the acknowledgement passage 15 of this piston opens, with the result that space R is filled and the detecting piston 12 is moved to its terminal position Z.

Figure 3D:
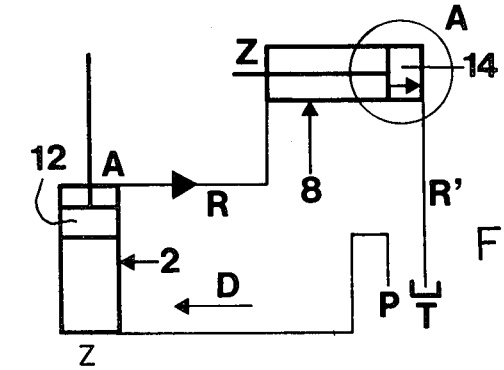

According to FIG. 3*d*, the power piston 14 has reached its terminal position A, whereas the detecting piston 12 is not yet in the terminal position. This means that an excess of liquid (fluid) exists within space R. When the detecting piston 12 is acted upon by the pressure acting in the direction of arrow D, the acknowledgement passage 15 of power piston 14 opens, with the result that excess liquid flows from space R through space R' to the reservoir T and the detecting piston 12 is likewise moved to its terminal position A.

Figure 3E:
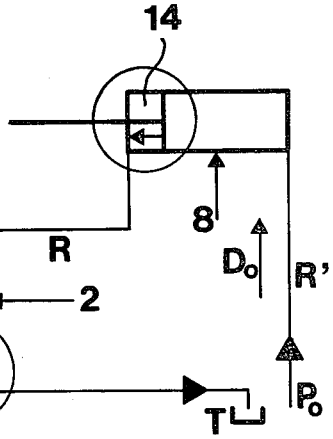
Figure 3F:
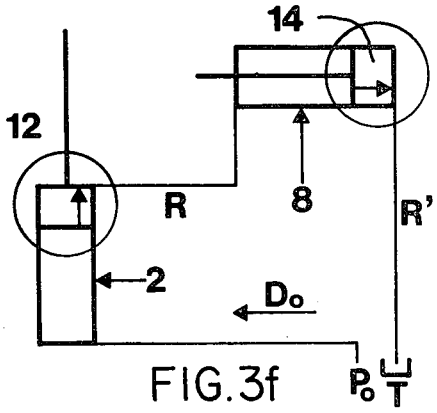

In FIGS. 3*e* and 3*f*, both the power piston and the detecting piston assume their respective terminal positions Z or A, respectively. Under a proper pressure acting in the direction of arrow $D_o$, both the acknowledgement passage 7 of detecting piston 12 and the acknowledgement passage 15 of power piston 14 are opened, with the result that a liquid circuit is established and the pressurized liquid or fluid may be readily cooled. Furthermore, the hydraulic system may be easily vented in this manner. Actually, the removal of air inclusions allows to idealize the synchronism between both pistons. The pump pressure for this cooling of the liquid may be substantially lower than the normal operating pressure. It may be spoken also of a so-called "pressure-less circulation of the pressurized liquid or fluid".

Figure 4:
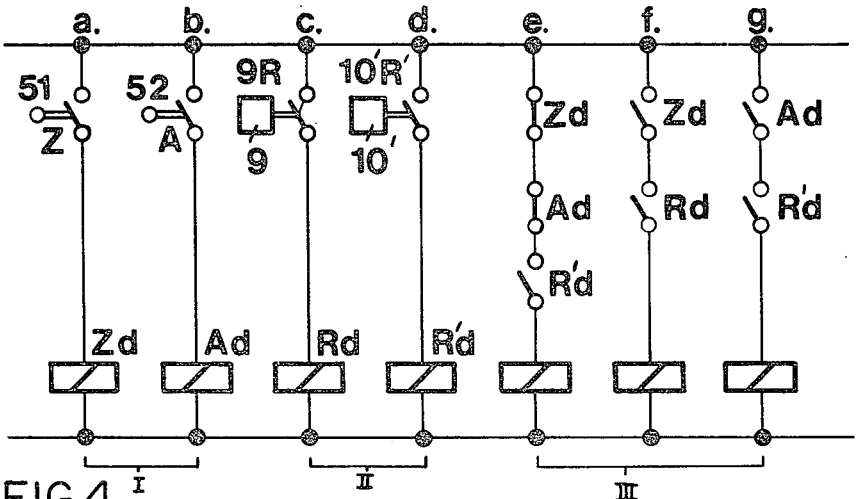
FIG. 4 is a schematic diagram showing a switching logic for the apparatus according to the invention.

FIG. 4 illustrates some examples of logic switching connections or linkages signalling the respective states of the system. The connection or circuit logic includes the two contacts 51 and 52 having respective relays Zd and Ad associated therewith, and the two pressure switches 9 and 10' which are likewise associated with corresponding relays Rd and R'd. Three different switching or connection states are shown, namely damper blocked or heavy load
correction in closing direction
correction in opening direction.

These last mentioned three switching or connection states provide secondary information, with the switching or connection states "correction in closing direction" and "correction in opening direction" each indicating that synchronization of power and detecting pistons is taking place and leakage has to be compensated for. In FIG. 4, also, the letters Z and A refer to the terminal positions of the pistons "closed" and "open", respectively. Numerals R and R' indicate the spaces or chambers defined in connection with FIGS. 3*a* to 3*f*.

The individual switching positions in FIG. 4 are a. Terminal position closed
b. Terminal position open
c. Level R
d. Level R'
e. Damper blocked or heavy load
f. Correction in closing direction
g. Correction in opening direction of the areas I Reference Cylinder II Pressure values III Secondary information.

Figure 5A:
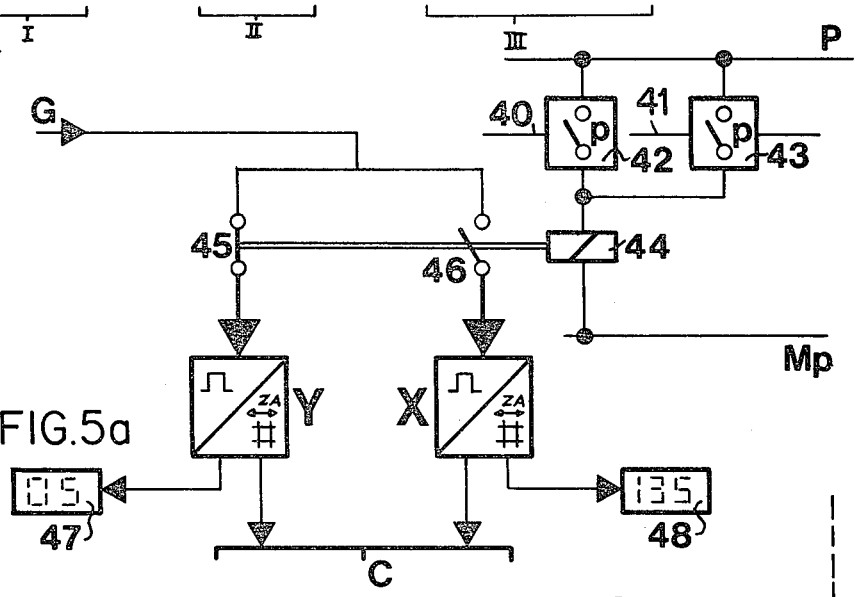
FIG. 5*a* is a schematic diagram of an additional switch device through which the influences of a mechanical tolerance play of hinges or connections and joints between the power cylinder and the element driven thereby are compensated in view of the necessary control.

The position of mask 35 in the opto coupler 4 can (according to FIG. 1) also be transmitted by way of an electric signal G to a process-computer or microprocessor. Thus, according to the scheme shown in FIGS. 5*a* and 5*b* it is possible to compensate and keep under control a more or less substantial movement or tolerance play within the mechanical connections between the power cylinder 8 and the element driven by this cylinder. Such tolerance play (being in the order of 10 mm or more) occurs for instance by wear of the hinges of a bell-crank operation system for a casting ladle opening slide and can cause substantial deviations from the real control characteristic.

For overcoming said tolerance movement play only a low pressure of the power cylinder 8 is necessary (for instance about 10 bar) while the movement of the casting ladle opening slide needs a far higher pressure (about 120–160 bar).

By connecting a connection pipe 40 and connection pipe 41 working in parallel to each other to the connection pipe 10 and/or the supply connection 17, pressure switches 42 and 43 having different levels of actuating pressure operate a relay 44. By this relay 44 the electric signals G (being preferably a constant number of impulses per time unit) are separated in part into time or movement components effected by the tolerance play, and in part into real movement time components of the working stroke of the power cylinder 8. Said different impulse components can be duly considered by a processor.

Upon activating the pressure switch 43 by a low pressure signal, switch 45 is a closed, and upon an elevated pressure signal caused by a real working stroke of the cylinder and the element driven thereby, switch 46 is closed. Thus, through switch 45 the undesired tolerance play movements are counted while switch 46 measures the real working movements, which different movements are counted in separate counters Y and X respectively and separately introduced into the processor C.

Figure 5B:
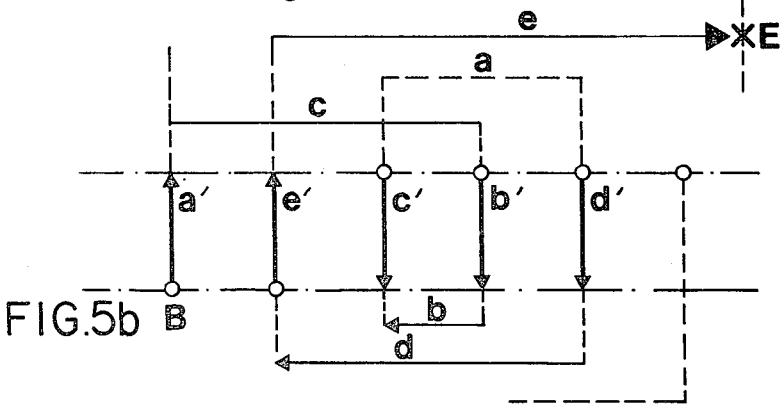
FIG. 5*b* is a schematic diagram showing the influences of such mechanical tolerance play on the actual movement of the element moved or actuated by the power cylinder.

The processor C then compensates the deviation caused by the idle or mere tolerance play movements of the power cylinder according to FIG. 5*b*. Starting at B in FIG. 5*b* in the sequence of the arrows a first tolerance play movement a' is followed by a real movement step a of the casting ladle opening slide. Upon further progress each further real movement a, b, c, d and e is combined with an idle movement a', b', c', d' and e' provided the direction of the movement is reversed from one to another direction. According to the direction of the real movement the values measured for the idle movements are considered as plus or minus.

By visible counters 47 and 48 the operator is informed about the wearing condition of the mechanical connections which information enables him to decide when they have to be repaired or rebuilt for allowing a reliable control of the process.

What we claim is:

1. An apparatus for the exact position feedback of a double-acting power piston in a hydraulic power cylinder subject to extreme environmental conditions especially high temperatures comprising: a double-acting detecting follower cylinder having a displacement volume equivalent to that of said power cylinder; a detecting piston in said detecting cylinder; an electrical detection means for detecting and indicating the position of said detecting piston; a first fluid conduit connecting the working space on one side of said power piston to said detecting cylinder on one side of said detecting piston; a second conduit connected to the spaces in said cylinder on the other sides of said pistons; a fluid pump; a fluid reservoir; a control valve operatively connected in said second conduit to selectively connect said spaces on the other sides of said pistons to said pump, and to said reservoir; a first and second pressure limiting switch operatively connected in said first and second conduits, respectively, to prevent transfer of pressure through said conduits which exceeds a predetermined value; a fluid passage through each piston interconnecting the spaces in each respective cylinder on opposite sides of the piston; valve means in each passage to control the flow of fluid therethrough; a pressure measuring device operatively connected to each pressure limiting switch to indicate the pressure in said conduits; a signal converter operatively connected to each of said pressure measuring devices to convert the pressure values to corresponding electrical signals; and a function computer operatively connected to said signal converters for controlling the position of said power piston in accordance with a pre-set value.

2. The apparatus as claimed in claim 1 wherein:

said electrical detection means comprises a detecting piston rod extending through an end of said detecting cylinder, an opto coupler having an opto coupler block with a scale thereon, and a mask mounted on said piston rod and extending into said opto coupler block; and said function computer is further operatively connected to said opto coupler to perform a comparison between the reference signals supplied by said opto coupler and the pressure measurement values converted to electric signals by said signal converter, for determining the exact power piston position and controlling a piston nominal position.

* * * * *